United States Patent [19]

Sodeno

[11] Patent Number: 4,819,318

[45] Date of Patent: Apr. 11, 1989

[54] METHOD OF ATTACHING PARTS OF SEPARABLE BOTTOM END ASSEMBLY TO A CONTINUOUS SLIDE FASTENER CHAIN

[75] Inventor: Toshiaki Sodeno, Toyama, Japan

[73] Assignee: Yoshida Kogyo K. K., Tokyo, Japan

[21] Appl. No.: 777,354

[22] Filed: Sep. 18, 1985

[30] Foreign Application Priority Data

Sep. 18, 1984 [JP] Japan ..... 59-195456

[51] Int. Cl.[4] ..... B21D 53/50

[52] U.S. Cl. ..... 29/408; 29/767

[58] Field of Search ..... 29/33.2, 408–410, 29/766–770

[56] References Cited

U.S. PATENT DOCUMENTS 3,714,698 2/1973 Fukuroi ..... 29/408

4,580,326 4/1986 Kawakami et al. ..... 29/408

FOREIGN PATENT DOCUMENTS 49-4243 11/1974 Japan .

*Primary Examiner*—Carl E. Hall

*Attorney, Agent, or Firm*—Hill, Van Santen, Steadman & Simpson

[57] ABSTRACT

In a method of attaching parts of a separable bottom end assembly to a continuous slide fastener chain, a box or insertion pin, in the shape of a channel, of a separable bottom end assembly is threaded onto one of longitudinally spaced successive element-free portions of one longitudinal edge of a continuous slide fastener stringer in an edgewise direction while the one element-free portion is kept stationary at an attaching station in a substantially horizontal path of the fastener stringer as the latter is at rest. The thus threaded pin is then fixedly secured to the one element-free portion by being compressed into a final shape therearound.

6 Claims, 6 Drawing Sheets

(PROR ART)

METHOD OF ATTACHING PARTS OF SEPARABLE BOTTOM END ASSEMBLY TO A CONTINUOUS SLIDE FASTENER CHAIN

BACKGROUND OF THE INVENTION

1. Field of the Invention

The present invention relates to the production of separable slide fasteners, and more particularly to a method of attaching parts of a separable bottom end assembly to a continuous slide fastener chain.

2. Description of the Prior Art

Japanese Patent Publication (Tokkosho) No. 49-44243 discloses an automatic finishing apparatus for separable slide fasteners, as reillustrated here in FIG. 4, in which publication an insertion pin 8*b* (FIG. 5A) and a box pin 8*a* (with a box 8*c*) (FIG. 6A), both in the shape of a channel, of a separable bottom end assembly are threaded onto the respective leading element-free end portions 4*a*, 4*a* of a pair of uncoupled continuous slide fastener stringers 2, 2 in an endwise direction, i.e. longitudinally from one of opposite end openings of the respective pin, as shown in FIGS. 5A and 6A. Each pin 8*a*, 8*b* is then fixedly secured to the element-free end portion 4*a* as compressed into a final shape (FIGS. 5B and 6B) therearound by means of a respective holder or punch B, C (FIG. 4). A common problem with this prior art method is that because of smallness of the end openings of the pin, it is difficult or impossible to mount the pin correctly in a required position on the leading element-free end portion, especiallly if the latter is in objectionably bulged or otherwise deformed condition. Further, this inaccurate and insufficient threading would be a cause for possible misoperations in various subsequent progressive finishing stages of the production, thus resulting in inadequate quality products.

SUMMARY OF THE INVENTION

According to the present method, a box or insertion pin, in the shape of a channel, of a separable bottom end assembly is threaded onto one of longitudinally spaced successive element-free portions of one longitudinal edge of a continuous slide fastener stringer in an edgewise direction while the one element-free portion is kept stationary at an attaching station in a substantially horizonital path of the fastener stringer as the latter is at rest. The thus threaded pin is then fixedly secured to the one element-free portion as compressed into a final shape therearound.

It is an object of the present invention to provide a method of attaching parts of a separable bottom end assembly to a continuous slide fastener chain easily with precision, thus making various subsequent progressive finishing stages of the production free from misoperations due to inaccurate mounting of the parts. Accordingly, the present invention is particularly suitable for automatic production of separable slide fasteners.

Many other advantages, features and additional objects of the present invention will become manifest to those versed in the art upon making reference to the detailed description and the accompanying drawings in which certain preferred embodiments incorporated the principles of the present invention are shown by way of illustrative example.

DETAILED DESCRIPTION

Figure 3A:
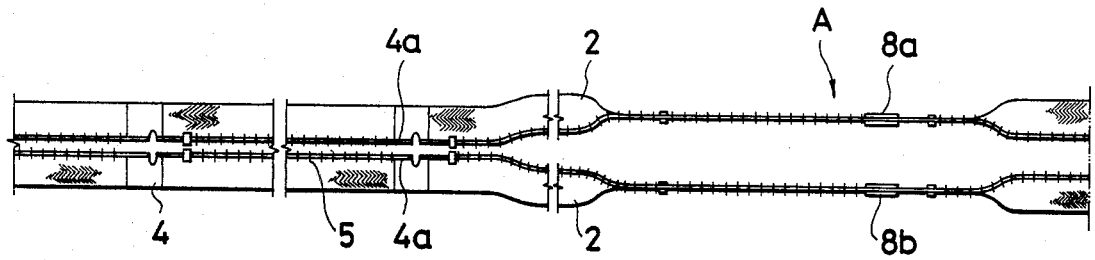
FIG. 3A is a fragmentary plan view of a pair of uncoupled continuous slide fastener stringers to which a box pin and an insertion pin have been attached respectively.
Figure 3B:
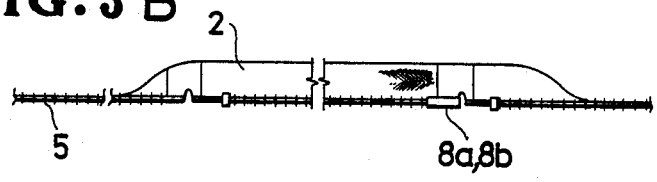
FIG. 3B is a side elevational view of a half of FIG. 3A, showing a twisted portion of each fastener stringer.
Figure 4:
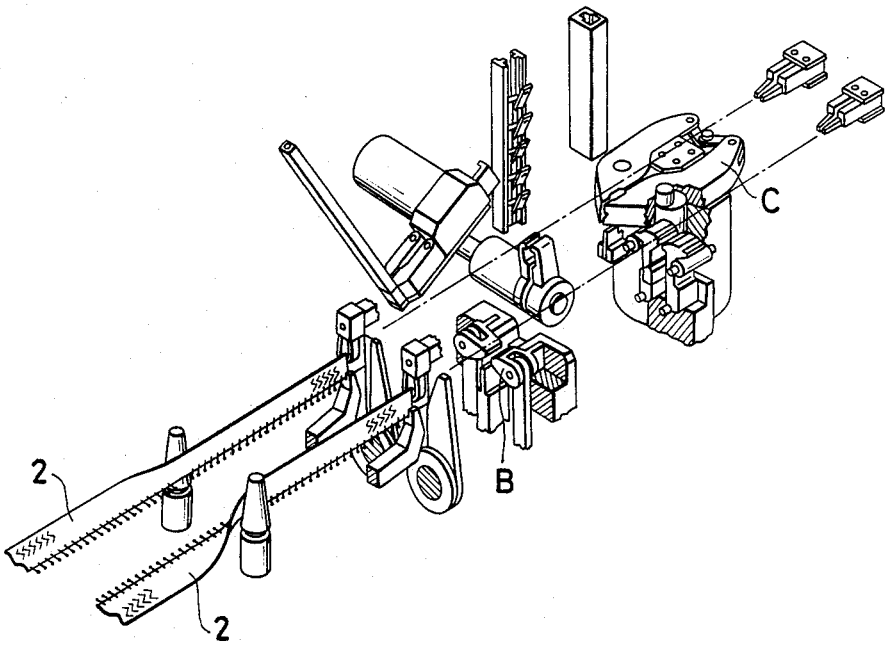
FIG. 4 (PRIOR ART)
FIG. 4 is a fragmentary perspective view of a prior art apparatus for automatically finishing separable slide fasteners.
Figure 5A:
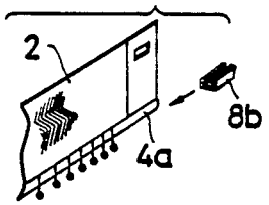
FIG. 5A (PRIOR ART)
FIGS. 5A and 5B illustrate the manner in which an insertion pin is attached to the fastener stringer by the prior art apparatus of FIG. 4.
Figure 5B:
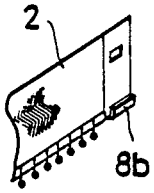
Figure 6A:
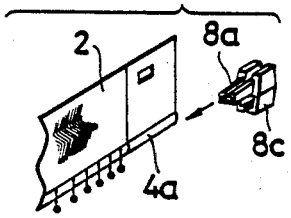
FIG. 6A (PRIOR ART)
FIGS. 6A and 6B illustrate the manner in which a box pin with a box is attached to the fastener stringer by the prior art apparatus of FIG. 4.
Figure 6B:
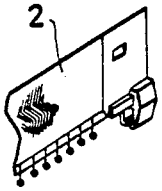
FIG. 6B (PRIOR ART)

FIG. 3A shows a pair of uncoupled slide fastener stringers 2, 2 being moved longitudinally along a substantialy horizontal straight path through an attaching station A (of a separable-slide-fastener finishing apparatus) where an insertion pin 8*b* and a box pin 8*a* are attached to inner longitudinal edges of the fastener stringers 2, 2, respectively, in a manner described below as each stringer 2 is partially twisted through an angle of 90° so as to assume an upright posture with its inner longitudinal edge directed downwardly as shown in FIG. 3B. Each fastener stringer 2 has longitudinally spaced element-free portions 4 devoid of coupling elements 5.

The movement of each fastener stringer 2 is temporarily terminated when one of the successive element-free portions 4 arrives at the attaching station A where a pair of holder or clamps 6, 6 are disposed below the stringer path and are movable vertically toward and away from the respective inner longitudinal edges of the two fastener strngers 2, 2. Meanwhile, each clamp 6 pre-clamps a box or insertion pin 8*a*, 8*b* of a channel shape delivered from a chute 10 onto an auxiliary support 7, as shown in FIGS. 1B and 2A, at which time the pin 8*a*, 8*b* is open widely with its opposite side walls diverging upwardly.

Figure 1A:
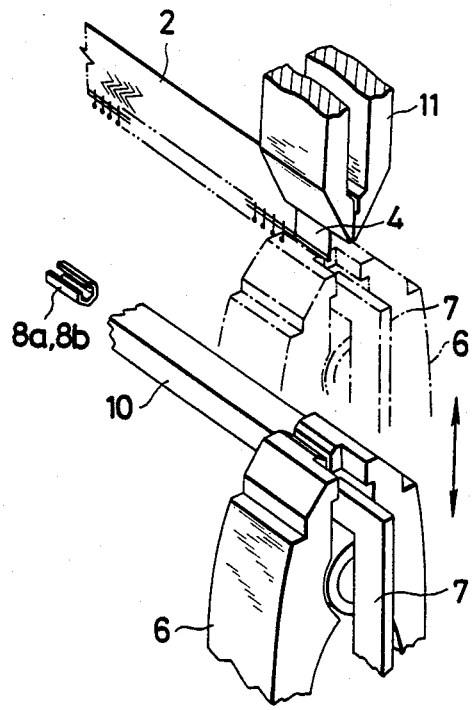
FIG. 1A is a fragmentary perspective view showing the manner in which a box or insertion pin is attached to a continuous fastener stringer at one element-free portion contiguous to a leading or cut end of the stringer.
Figure 1B:
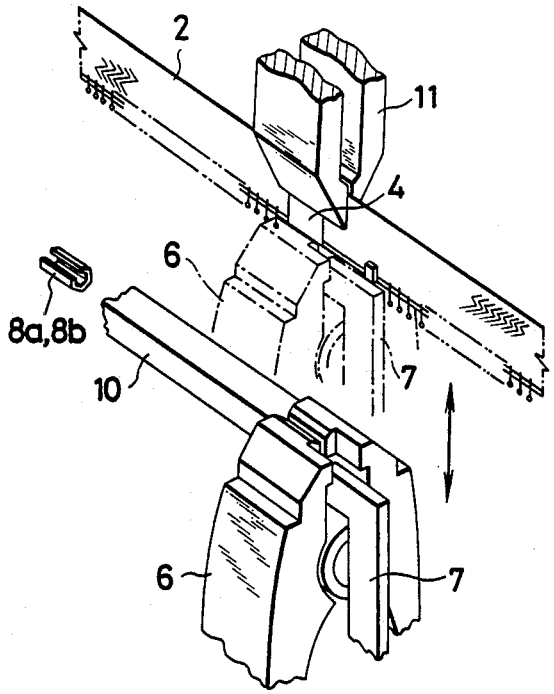
FIG. 1B is a view similar to FIG. 1A, showing the manner is which a box or insertion pin is attached to a continuous fastener stringer at one element-free portion remote from a leading or cut end of the stringer.
Figure 2A:
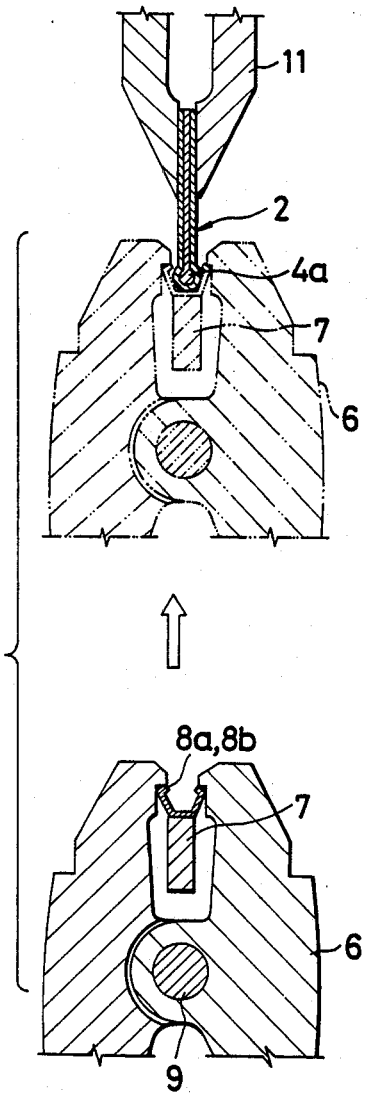
FIG. 2A is a fragmentary cross-sectional view showing the manner is which the pin is threaded onto the inner longitudinal edge of the fastener stringer by a holder or clamp.

Upon termination of the movement of the fastener stringers 2, 2, each clamp 6 holding the respective pin 8*a*, 8*b* is raised from the solid-line position to the phantom-line position in FIGS. 1B and 2A until the pin 8*a*, 8*b* is threaded onto the inner longitudinal edge 4a of the one element-free portion 4 is an edgewise direction from a longitudinal upward opening of the channel (of the pin 8*a*, 8*b*), i.e. in the direction perpendicular to the longitudinal edge of upright fastener stringer 2. At that time, since the longitudinal upward opening of its channel is open widely, each pin 8*a*, 8*b* can be threaded over the element-free inner longitudinal edge 4*a* in a proper posture to a required extent without difficulty even if the latter is in an objectionably bulged or otherwise damaged condition.

Figure 2B:
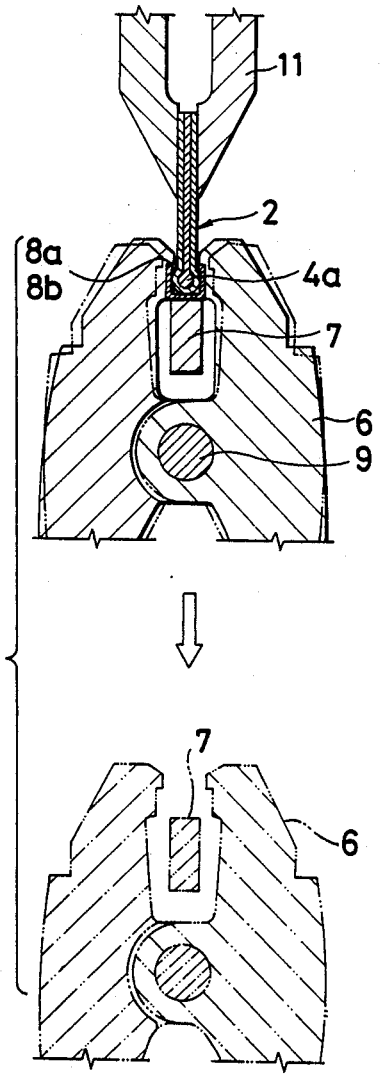
FIG. 2B is a view similar to FIG. 2A, showing the manner in which the threaded pin is fixedly secured to the inner longitudinal edge of the fastener stringer as compressed by the holder or clamp.

Then the thus threaded pin 8*a*, 8*b* is compressed into a final shape about the element-free longitudinal edge 4*a* as a pair of parts of each clamp 6 are angularly moved relative to one another about a pivot 9 from the position of dash-and-two-dot lines to the position of solid lines in FIG. 2B. As a result, each pin 8*a*, 8*b* has been fixedly secured to the longitudinal edge 4*a* of the one element-free portion of the respective fastener stringer 2 precisely at a required position in a proper posture.

During the threading and compressing, each fastener stringer 2 is kept in a state of tension as gripped by upstream and downstream grippers 11 (only upstream gripper is illustrated).

Finally, each clamp 6 opens to release the respective attached pin 8*a*, 8*b* and returns to the initial or lower position (dash-and-two-dot lines) in FIG. 2B. The resulting fastener stringers 2, 2 are further moved to the following station where a subsequent finishing process, such as cutting or pairing, may take place.

In the embodiment of FIGS. 1B, 3A and 3B, each pin 8*a*, 8*b* is attached to the respective fastener stringer 2 at one element-free portion 4 that is remote from the leading or cut end of the fastener stringer 2. Alternatively, the pin 8*a*, 8*b* may be attached to the fastener stringer 4 at one element-free portion 4 that is contiguous to the leading or cut end of the fastener stringer 2, as shown in FIG. 1A; that is, the attaching takes place after a preceding piece of the fastener stringer of the individual slide fastener length (not shown) has been cut from the continuous fastener stringer 2 across that one elmenent-free portion 4.

Although various minor modifications may be suggested by those versed in the art, it should be understood that I wish to embody within the scope of the patent warranted hereon, all such embodiments as reasonably and preperly come within the scope of my contribution to the art.

What is claimed is:

1. In the production of separable slide fasteners each having a separable bottom end assembly, a method of attaching a box with a channel-shaped pin or insertion pin as a channel-shaped pin to one longitudinal edge of a continuous fastener stringer at one of a number of longitudinally spaced successive element-free portions thereof, said method comprising the steps of:

(a) moving the fastener stringer longitudinally along a substantially horizontal path;

(b) temporarily terminating the movement of the fastener stringer when one of the successive element-free portions arrives at an attaching station;

(c) threading the channel-shaped pin onto said one element-free portion of the one longitudinal edge of the fastener stringer by moving the pin in a direction perpendicular to the edge as the latter is at rest; and (d) fixedly securing the threaded channel-shaped pin to said one element-free portion by compressing said pin into a final shape around said one longitudinal edge of the fastener stringer while the latter is at rest.

2. A method according to claim 1, wherein said one element-free portion is disposed contiguously to a leading end of the fastener stringer.

3. A method according to claim 1, wherein said one element-free portion is disposed remotely from a leading end of the fastener stringer.

4. A method according to claim 1, wherein the fastener stringer is kept in a state of tension during said threading and said securing steps.

5. A method of attaching a box of insertion pin of a separable body assembly of a separable slide fastener to one longitudinal edge of a continuous fastener stringer at a location of one of a plurality of longitudinally spaces successive element-free portions thereon, each of said box and insertion pins having channel-shaped portions, said method comprising the steps of: moving the fastener stringer longitudinally along a substantially straight path; temporarily terminating the movement of the fastener stringer when one of the element-free portions arrives at an attaching station; moving the channel-shaped portion in a direction at right angles to said staight path toward the one longitudinal edge of the fastener stringer to thread the channel-shaped portion onto said one element-free portion as the stringer is in a rest position; and fixedly securing the assembled channel-shaped portion to said one free edge portion by compressing said channel-shaped portion into a final shape around said one longitudinal edge of the stringer fastener while holding the stringer at rest.

6. A method according to claim 5, wherein the step of temporarily terminating the movement positions the elementfree portion extending between two sections containing closure elements so that said channel-shaped portion is fixedly secured between said two sections containing closure elements.

* * * * *